United States Patent [19]

Stafford

[11] 4,450,055

[45] May 22, 1984

[54] ELECTROGENERATIVE PARTIAL OXIDATION OF ORGANIC COMPOUNDS

[75] Inventor: Gery R. Stafford, Warren, N.J.

[73] Assignee: Celanese Corporation, New York, N.Y.

[21] Appl. No.: 480,441

[22] Filed: Mar. 30, 1983

[51] Int. Cl.[3] ..... C25B 3/02

[52] U.S. Cl. ..... 204/78; 204/80; 429/13

[58] Field of Search ..... 204/78, 79, 80; 429/13

[56] References Cited

U.S. PATENT DOCUMENTS

| | | | |
|---|---|---|---|
| 3,245,890 | 4/1966 | Klass | 204/80 |
| 3,248,312 | 4/1966 | Young | 204/80 |
| 3,280,014 | 10/1966 | Kordesch | 204/78 |
| 3,316,161 | 4/1967 | Jung et al. | 204/79 |
| 3,329,593 | 7/1967 | Griffin et al. | 204/80 |
| 3,379,626 | 4/1968 | Hense et al. | 204/80 |
| 4,383,899 | 5/1983 | Kuder | 204/80 |

*Primary Examiner*—John F. Niebling

*Attorney, Agent, or Firm*—Depaoli & O'Brien

[57] ABSTRACT

This invention provides an electrochemical process for electrogenerative partial oxidation of methyl-substituted hydrocarbons such as ethane, propylene and toluene.

Ethane is oxidized to products such as acetaldehyde and acetic acid, and propylene converts to acrolein and acrylic acid.

12 Claims, 3 Drawing Figures

ELECTROLYTE OUTFLOW
24
ELECTROLYTE RESERVOIR
10
11
15
PUMP
16
FEEDSTOCK FUEL INFLOW
26
25
35
36
O2 INFLOW
37
ANODE
20
22
23
30
CATHODE
21
CATHODE LEAD
41
ANODE LEAD
40
38
31
O2 OUTFLOW
FEEDSTOCK FUEL OUTFLOW
ELECTROLYTE INFOW
15
39
CATHODE COLD TRAP
32
ANODE COLD TRAP
VARIABLE RESISTOR
45
COULOMBS
43
CURRENT
42
CELL VOLTAGE
44

ELECTROGENERATIVE PARTIAL OXIDATION OF ORGANIC COMPOUNDS

BACKGROUND OF THE INVENTION

In a fuel cell mode of electrochemical conversion, an organic fuel such as a hydrocarbon or an oxygen-containing organic compound (e.g., an alcohol, aldehyde, ketone, ether or ester) is directly converted into electrical energy and simultaneously oxidized in various stages to carbon dioxide. Such fuel cells include an anode or fuel electrode, a cathode or oxygen electrode, respective supplies of an organic fuel, an oxidizing agent consisting of, or containing, molecular oxygen, and an aqueous electrolyte in which the electrodes are immersed. With the use of an alkaline electrolyte, oxygen is reacted with the aqueous electrolyte solution to form negatively charged ions at the cathode, fuel is oxidized at the anode, and free electrons are released upon a conducting surface of the anode. When an acidic electrolyte is utilized, hydrogen ions formed at the anode migrate to the cathode where water is formed. When current is drawn from the cell, there is a net flow of electrons from the anode through an external circuit to the cathode.

During this direct conversion of the chemical energy of the hydrocarbon fuel to electrical energy, the fuel is oxidized in various stages until it has been converted into carbon dioxide. Carbon dioxide is the anodic compartment effluent when a fuel cell is operating in a conventional manner, and the primary objective is the production of electrical energy.

There has been increasing interest in the potential use of electrogenerative processes for the production of oxygenated organic compounds from a feed source that has a lower state of oxidation than the oxygenated conversion products, concomitant with the generation of electrical energy. With respect to a fuel cell, the oxygenated conversion products would represent an oxidation state in an intermediate oxidation range between the starting material and carbon dioxide.

U.S. Pat. No. 3,245,890 describes an electrochemical process for simultaneous production of carbonyl compounds and electrical energy with a system of separate anodic and cathodic zones. The anodic zone contains an acidic aqueous solution of a platinum group metal halide. Olefin feed is introduced into the anodic zone, and an oxidizing agent is introduced into the cathodic zone. Butene-1 converts to methyl ethyl ketone product. The metal halide functions as an oxidizing agent, and is in turn re-oxidized at the anodic electrode.

U.S. Pat. No. 3,280,014 describes a fuel cell operation in which an alcohol is oxidized to a carbonyl compound at the fuel electrode, such as the conversion of benzyl alcohol to benzaldehyde. The dehydrogenation of cyclic hydrocarbons to aromatic hydrocarbons is also disclosed. Both electrodes are constructed of activated porous carbon.

U.S. Pat. No. 3,316,161 describes a multi-stage fuel cell system for partially oxidizing an alcohol feed stepwise to different levels of oxidation to carbonyl and carboxylic acid compounds.

U.S. Pat. No. 3,329,593 describes a continuous process in which a $C_4$ hydrocarbon mixture of isobutylene, n-butylenes and butanes is contacted with a first aqueous sulfuric acid solution to extract the isobutylenes, and the mixture is contacted with a second aqueous sulfuric acid solution to extract the n-butylenes. The acidic n-butylene extract phase is contacted with a fuel electrode to convert n-butylene to methyl ethyl ketone, and the residual butane fraction from the previous extraction cycles is used to extract the methyl ethyl ketone from the anolytic medium.

U.S. Pat. No. 4,347,109 describes a method of producing acetaldehyde which involves passing gaseous ethanol in contact with a gas-permeable fluid-impermeable fuel electrode, and recovering acetaldehyde as a component of the gas phase effluent from the anodic compartment.

There remains a need for the development of efficient electrogenerative systems for the production of value-added organic chemicals for inexpensive feedstocks.

Accordingly, it is an object of this invention to provide an improved electrochemical system for electrogenerative partial oxidation of hydrocarbon feedstock.

It is another object of this invention to provide an electrogenerative process for converting hydrocarbons to partially oxidized products with a high current efficiency.

Other objects and advantages of the present invention shall become apparent from the accompanying description and examples.

BACKGROUND OF THE INVENTION

One or more objects of the present invention are accomplished by the provision of a continuous electrochemical process for partial oxidation of organic compounds which comprises contacting a palladium anode with a methyl-substituted hydrocarbon in a fuel cell containing an acidic aqueous electrolyte at a temperature between about 40°–200° C. to form corresponding aldehyde and carboxylic acid products, wherein the electrogenerative current density is in the range between about 0.5–20 milliamperes per square centimeter at a resistive load of 1–150 ohms, the anodic potential is in the range between about 0–0.55 volts with reference to a saturated calomel electrode, and the molar selectivity of methyl-substituted hydrocarbon conversion to aldehyde and carboxylic acid is at least about 80 percent.

The methyl group in the methyl-substituted hydrocarbon starting material under the anodic zone conditions oxidizes to an aldehyde or carboxylic acid structure. If more than one oxidizable methyl group is contained in a hydrocarbon (e.g., p-xylene), then oxidation products such as p-toluic acid and terephthalic acid are obtained.

The methyl-substituted hydrocarbon can contain heteroatoms such as oxygen, nitrogen, sulfur and halogen which do not interfere with the operation of the electrogenerative process, and the partial oxidation of methyl-substituted feedstocks at the anodic electrode.

Illustrative of methyl-substituted hydrocarbons are acyclic and cyclic alkanes and alkenes, and alkyl-substituted aromatic compounds, such as ethane, propane, pentane, 2-ethylhexane, decane, eicosane, propene, butene, hexene, methylcyclopentane, ethylcyclohexene, toluene, xylene, 4-chlorotoluene, 2-methylpyridine, 1-methylnaphthalene, and the like.

The recovery of the partial oxidation products which form in the anodic zone is accomplished by one or more procedures, depending on the particular oxygenated components being produced and recovered. A product such as acetaldehyde (from ethane starting material) is sufficiently volatile that it can be obtained as a component of the gaseous effluent from the anodic zone during the course of the electrochemical process. This type of recovery procedure is described in U.S. Pat. No. 4,347,109.

Higher boiling oxidation products remain dissolved in the electrolyte. Preferably, the aqueous electrolyte is continuously fed into the electrolyte compartment, and electrolyte containing dissolved organic oxidation products is continuously withdrawn from the electrolyte compartment. The organic oxidation products can be recovered from the withdrawn aqueous electrolyte by distillation, or by extraction of the aqueous electrolyte with an organic solvent such as benzene. The resultant product-free aqueous electrolyte is recycled in the process.

The electrolyte utilized in the invention process is an aqueous medium containing between about 0.5–75 weight percent of an acid reagent such as sulfuric acid, perchloric acid or phosphoric acid. If the electrochemical cell is divided into two separate compartments, then the anolyte and the catholyte can be the same or different types of aqueous electrolyte media. The pH of the aqueous electrolyte usually will be less than about 3.

The electrochemical cells consisting of separate anode and cathode zones, the zones are connected through an external electric circuit, and the zones are further connected by a salt bridge or a semi-permeable membrane; as described in U.S. Pat. No. 3,245,890 and U.S. Pat. No. 3,427,235, incorporated by reference.

The cell is constructed of suitable materials which can withstand the corrosive acidic environment. The electrodes preferably are oxidation-resistant highly porous substrates. For example, the anode can be constructed of Raney palladium. The cathode can be constructed of Raney silver, Raney platinum, or the like, or can be in the form of a screen or grid.

Because of the heterogeneous phases involved in the electrogenerative operation of the fuel cell system, it is necessary to provide for intimate contact of the hydrocarbon, electrolyte and anode entities. One effective means of providing a high surface area of contact is to introduce the hydrocarbon feedstock as a gaseous stream through a porous anode. The time of contact of the hydrocarbon stream with the anode and electrolyte phases varies from a fraction of a second up to several minutes, depending on such factors as gas flow rate and area of surface contact.

An important aspect of an electrochemical process operating in a fuel cell mode is the relationship of anodic potential to the efficiency of fuel oxidation and generation of electrical energy. As indicated above, an electrogenerative process is in general a coupling of suitable electrochemical reactions at opposing electrodes, separated by an electrolyte barrier to yield a desired chemical product (e.g., a partially oxidized hydrocarbon) with a generation of low voltage electrical energy as a byproduct.

The current (rate of reaction) is controlled by an external load resistor. The anodic and cathodic potentials are functions of the current by the following simplified equations:

$$E_a = E_a^\circ + b_1 \log i_a$$

$$E_c = E_c^\circ - b_2 \log i_c$$

$E_a^\circ$ and $E_c^\circ$ are reversible potentials, $b_1$ and $b_2$ are kinetic parameters, and $i_a$ and $i_c$ are the anodic and cathodic current densities.

In accordance with these equations, as more current is allowed to pass (lower resistance) the anodic potential increases and the cathodic potential decreases. Since the potential at which the electrode operates determines the reaction which takes place (e.g., partial oxidation), rigorous control of this potential is desirable in order to control the reaction selectivity.

Control of potential in an electrochemical system of the type described above usually is achieved by operating at a constant current, with the need that the kinetics and mass transport remain constant so that a constant potential is maintained. In essence, the potential is indirectly controlled by controlling the current. In practice, this indirect method of controlling the half-cell potential in a thermodynamically favorable electrochemical system is unsatisfactory.

Accordingly, in another embodiment the present invention provides an electrochemical process for partial oxidation of organic compounds, which is operated in combination with a self-adjustable unipolar resistive load for controlling the half-cell anodic potential.

In another embodiment, the present invention provides an electrogenerative process for partial oxidation of organic compounds, which process is operated as dynamic electronic system with control of the half-cell anodic potential. The dynamic electronic system comprises:

an operating electrochemical cell;

a reference electrode;

an input electrometer circuit for measuring the potential between the reference electrode and the working electrode of the thermodynamically favorable electrochemical cell;

a variable reference offset voltage source circuit for selecting a specific potential for the working electrode, and for algebraically combining the electrometer output potential with the selected potential to produce a signal which is the difference between the actual working electrode potential and the selected potential;

a voltage amplifier circuit for amplifying the said signal; and a dynamic load circuit for receiving the amplified signal and regulating the impedance of the dynamic load to adjust the half-cell potential of the working electrode to the selected potential level.

In a further embodiment, the present invention provides and electrogenerative process for partial oxidation of organic compounds, which process is operated in combination with a passive potentiostat device adapted to function as a self-adjustable unipolar resistive load, which device comprises:

an input electrometer circuit for measuring the potential between a reference electrode and a working electrode of a thermodynamically favorable electrochemical cell;

a variable reference offset voltage source circuit for preselecting a specific potential for the working electrode, and for algebraically combining the electrometer output potential with the selected potential to produce a signal which is the difference between the actual working electrode potential and the selected potential;

a voltage amplifier circuit for amplifying the said signal; and a dynamic load circuit for receiving the amplified signal and regulating the impedance of the dynamic load to adjust the half-cell potential of the working electrode to the selected potential level.

A suitable passive potentiostat device is disclosed in copending patent application Ser. No. 410,284, filed Aug. 8, 1982; incorporated herein by reference. The said disclosure describes the utility of the passive potentiostat in combination with an electrogenerative type process. In operation, the passive potentiostat circuitry forms a closed loop control system when used in conjunction with a thermodynamically favorable electrochemical cell operation. A dynamic load resistance is placed across the cell electrodes, and a cell current is allowed to flow so as to maintain a fixed potential between the working and reference electrodes.

Figure 1:
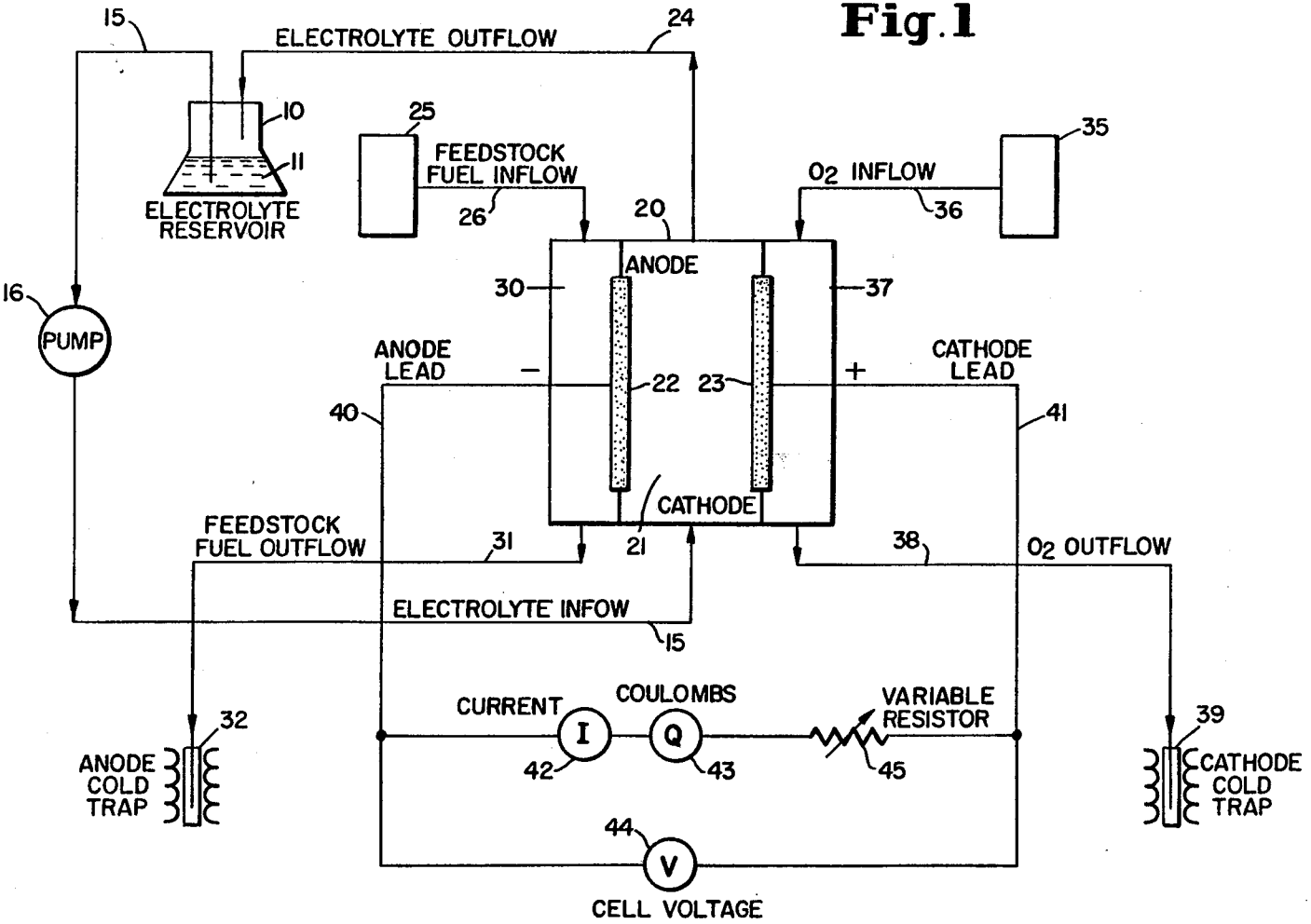
FIG. 1 is a schematic diagram of an electrogenerative three-compartment cell in combination with a system of inflow and outflow conduits.
Figure 2:
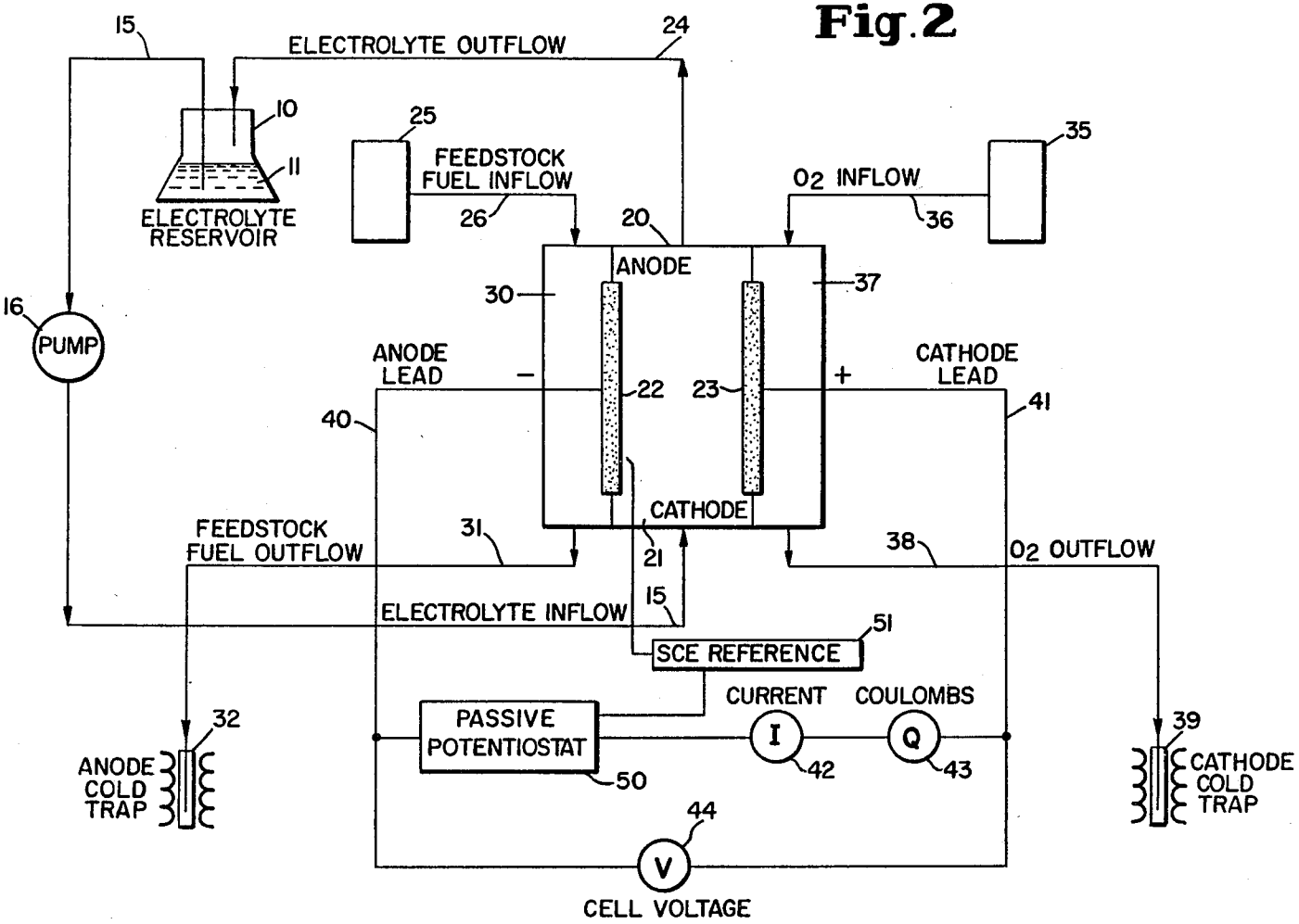
FIG. 2 is a schematic diagram of the FIG. 1 operational arrangement, with a passive potentiostat for control of anodic potential by variable load resistance.

Referring to FIG. 1 and FIG. 2, reservoir 10 contains electrolyte 11. The transfer of electrolyte 11 is through inflow line 15 by means of pump 16 to fuel cell 20. Electrolyte 11 passes through compartment 21 to contact with anode 22 and cathode 23, and is withdrawn via outflow line 24 for recycle to reservoir 10.

Feedstock fuel 25 is supplied by inflow line 26 to compartment 30 in fuel cell 20. Fuel 25 passes through compartment 30 in contact with anode 22, and is withdrawn via outflow line 31 for transport to cold trap 32 (for accumulation of partial oxidation products).

Oxygen gas 35 is supplied by inflow line 36 to compartment 37, where oxygen gas 35 passes in contact with cathode 23. Oxygen gas 35 is withdrawn from compartment 37 by means of outflow line 38 for transport to cold trap 39.

Anode 22 and cathode 23 are connected by an outside circuit through anode lead 40 and cathode lead 41.

The current, coulombs and cell voltage are monitored by ammeter 42, coulometer 43 and voltmeter 44, respectively.

In FIG. 1, variable resistor 45 is indicated. In FIG. 2, in place of variable resistor 45 there is provided passive potentiostat 50 and saturated calomel reference electrode 51 for control of the anodic potential at a selected level by variable load resistance.

The following Examples are further illustrative of the present invention. The catalysts and other specific materials and processing parameters are presented as being typical, and various modifications can be derived in view of the foregoing disclosure within the scope of the invention.

EXAMPLE I

This Example illustrates the electrogenerative partial oxidation of ethane.

The fuel cell employed is a three-compartment unit supplied by Giner Inc. (Waltham, Mass.).

The electrodes also function as cell compartment dividers as shown in FIG. 1. The electrodes are porous structures which are constructed by spreading a catalyst-teflon slurry over a stainless steel screen. A teflon film is attached to the fuel compartment side of the screen electrode, and the structure is hot pressed.

The fuel cell is assembled using a palladium anode and a platinum cathode. The electrolyte reservoir is filled with 25% $H_3PO_4$ which is then pumped through the electrolyte chamber of the fuel cell. The electrolyte is continually pumped through the cell during the entire run. The cold traps are filled with distilled water and placed in an ice/water bath. The fuel cell is then heated to 80° C. When the temperature is reached the flow of gases is started with ethane entering the anode compartment and oxygen entering the cathode compartment. The open circuit cell potential is monitored at this time. When the potential stabilizes (about 0.3 volts), the variable load resistor is reduced to start the flow of current. The resistance employed is 10 ohms plus the 1.4 ohms for the ammeter and coulometer. After the desired resistance load is set, the current and passed coulombs and the cell voltage are monitored. The initial current density (after double layer charging) is about 0.7 mA/cm$^2$, and during the course of the run it stabilizes at 0.5 mA/cm$^2$. After three hours (70 coulombs), the cell is switched to open circuit and the electrolyte and traps are analyzed for products.

The electrolyte reservoir (11.0 ml) is found to contain 5.09 mM of acetic acid and 0.21 mM of acetaldehyde. This accounts for 33.4 of the 70 coulombs passed. The anode trap (4.0 ml) contains 12.8 mM of acetaldehyde, accounting for 19.8 coulombs. No acetic acid is detected in the anode trap. The cathode trap (10.5 ml) contains 0.31 mM of acetaldehyde, thus accounting for 1.3 additional coulombs. In total, 54.5 of the 70 coulombs passed are the result of ethane oxidation to acetaldehyde and acetic acid. If it is assumed that the remaining coulombs derived from the complete oxidation of ethane to $CO_2$ (no other products were detected using GC/MS), then the molar selectivity of ethane to acetic acid is 45% and to acetaldehyde is 46%.

It is found that most of the acetaldehyde (B.P. 20.8°C.) volatilizes in the fuel cell and is entrained by the ethane flow. The acetic acid remains in the electrolyte, and this provides a method of separating the two products.

Figure 3:
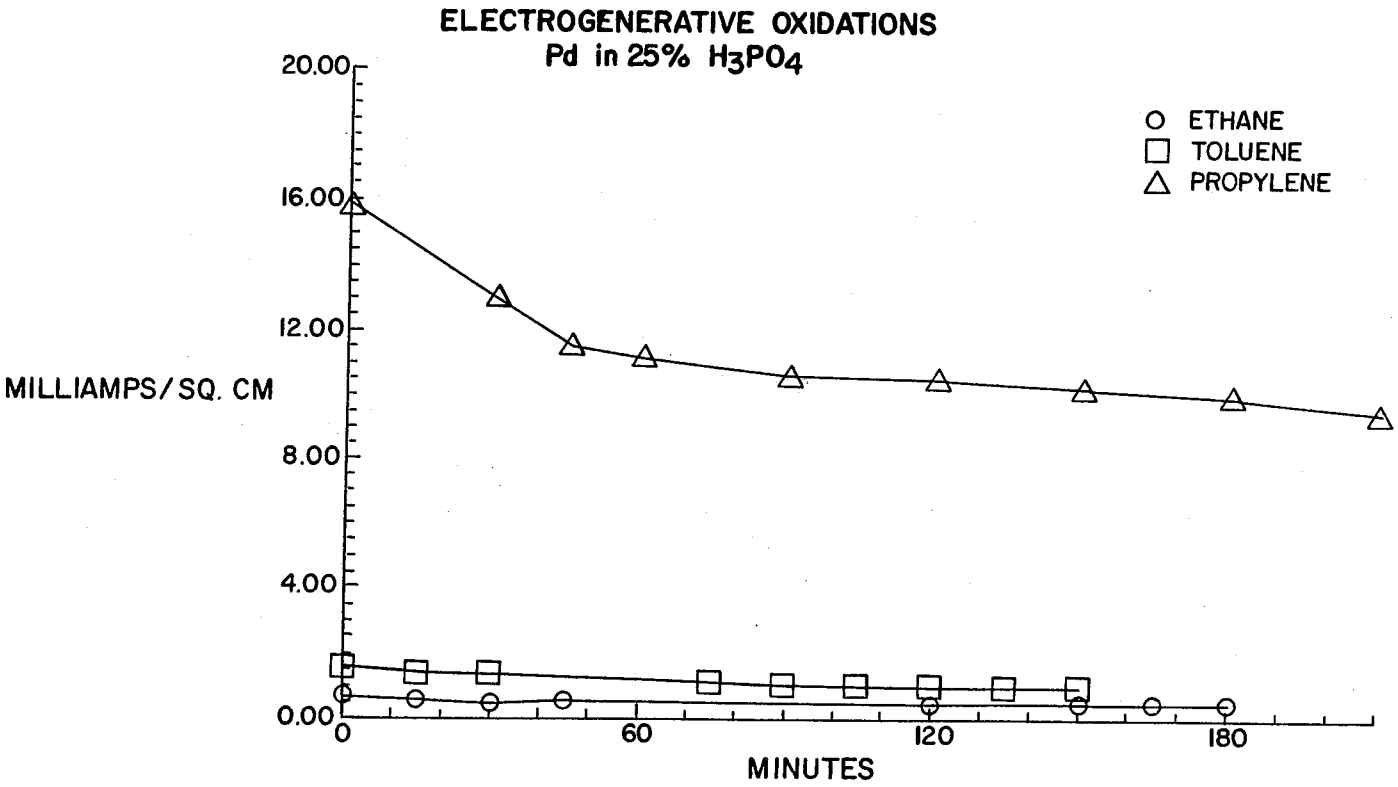
FIG. 3 is a graph plot illustrating electrogenerative oxidation of ethane, propylene and toluene, respectively, with respect to milliamperes per square centimeter versus time in minutes.

The results of an electrogenerative partial oxidation of ethane operation are illustrated in FIG. 3, in terms of milliamperes per square centimeter versus time in minutes.

Since rigorous control of the anode half-cell potential offers better product selectivity, a passive potentiostat is added to the electrogenerative system which allows operation at a fixed anodic potential. The passive potentiostat replaces the variable resistor of FIG. 1, and requires the addition of a reference electrode to the fuel cell (as shown in FIG. 2). The potentiostat utilizes an FET which acts as a passive variable resistive load providing a means of current flow from the fuel cell. The potentiostat maintains the actual anodic half-cell potential at the desired value by varying the drain-source resistance of the FET in a manner which minimizes the difference between the desired and actual half-cell potential. If the potential of the anode should increase for any reason, the potentiostat increases the drain-source resistance thus lowering the fuel cell current. This continues until the potential drops back to the desired level.

Depending upon the load resistance across the cell during an electrogenerative oxidation, the potential of the anode can be anywhere from 0 to 0.55 volts/SCE. Once the operating potential for the greatest selectivity is determined, the passive potentiostat will maintain that potential despite other fluctuations in the system.

EXAMPLE II

This Example illustrates the electrogenerative partial oxidation of propylene.

The fuel cell and procedure are the same as those described in Example I, except that propylene is passed through the anode chamber.

The open circuit potential is monitoried until it stabilizes (about 0.75 volts). When the load resistor is reduced to 10 ohms, the initial current density is 16.0 $mA/cm^2$. After three and a half hours the current drops to 9.3 $mA/cm^2$. The trap contents and electrolyte are then analyzed.

The electrolyte (13.9 ml) contains 40.6 mM of acrylic acid and 19.1 mM of acrolein. These two products account for 429 of the 1386 coulombs passed. The electrolyte also contains 9.6 mM of acetic acid and 3.6 mM of acetaldehyde, products resulting from cleavage of the double bond. The anode trap (5.1 ml) contains 34.9 mM of acrolein (69 coulombs) and 1.5 mM of acetaldehyde. The cathode trap (6.2 ml) contains 8.7 mM of acrolein (21 coulombs) and 2.4 mM of acetaldehyde. If it is assumed that the only other reaction occuring is the propylene oxidation to $CO_2$, (no additional products were detected using GC/MS), then the molar selectivity of propylene to acrylic acid is 35% and to acrolein is 30%.

The results of an electrogenerative partial oxidation of propylene operation are illustrated in FIG. 3, in terms of milliamperes per square centimeter versus time in minutes.

EXAMPLE III

This Example illustrates the electrogenerative partial oxidation of toluene.

The fuel cell and procedure are the same as those described in Example I, except that toluene is passed through the anode chamber instead of ethane.

A 50 ml quantity of toluene is heated to 60° C. in a container. Argon is bubbled through the heated toluene, and an effluent stream of argon and volatilized toluene is entered into the anode chamber.

The stabilized open circuit potential is 0.554 volts. When the load resistor is reduced to 10 ohms, the initial current density is 1.6 $mA/cm^2$. After two and a half hours (105 coulombs) the current density steadily drops to 0.9 $mA/cm^2$. The electrolyte and traps are then analyzed.

The electrolyte (13.0 ml) contains 7.6 mM of benzoic acid and 1.8 mM of benzaldehyde, accounting for 66 coulombs. The electrolyte also contains 0.36 mM of benzene. The anode trap (13.2 ml) contains 0.96 mM of benzoic acid and 0.19 mM of benzaldehyde, accounting for 8.3 coulombs. The anode trap also contains 4.3 mM of benzene. Assuming that the benzene comes from the decarboxylation of the benzoic acid, all of the coulombs passed are accounted. The molar selectivity of toluene to benzoic acid is 63% and to benzaldehyde is 14%. The remaining 23% oxidizes to benzene and to $CO_2$.

What is claimed is:

1. A continuous electrochemical process for partial oxidation of organic compounds which comprises contacting a palladium anode with a methyl-substituted hydrocarbon in a fuel cell containing an acidic aqueous electrolyte at a temperature between about 40°-200° C. to form corresponding aldehyde and carboxylic acid products, wherein the electrogenerative current density is in the range between about 0.5-20 milliamperes per square centimeter at a resistive load of 1-150 ohms, the anodic potential is controlled at a selected level in the range between about 0-0.55 volts with reference to a saturated calomel electrode, and the molar selectivity of methyl-substituted hydrocarbon conversion to aldehyde and carboxylic acid is at least about 80 percent, and wherein the oxidation occurs at the methyl-substituent of the hydrocarbon starting material.

2. An electrochemical process in accordance with claim 1 wherein the electrolyte is aqueous phosphoric acid.

3. An electrochemical process in accordance with claim 1 wherein the oxygen counter electrode is a platinum cathode.

4. An electrochemical process in accordance with claim 1 wherein the methyl-substituted hydrocarbon is an alkane hydrocarbon.

5. An electrochemical process in accordance with claim 1 wherein the methyl-substituted hydrocarbon is an alkene hydrocarbon.

6. An electrochemical process in accordance with claim 1 wherein the methyl-substituted hydrocarbon is an aromatic hydrocarbon.

7. An electrochemical process in accordance with claim 1 wherein the methyl-substituted hydrocarbon is ethane, and the partial oxidation product comprises acetaldehyde and acetic acid.

8. An electrochemical process in accordance with claim 1 wherein the methyl-substituted hydrocarbon is propylene, and the partial oxidation product comprises acrolein and acrylic acid.

9. An electrochemical process in accordance with claim 1 wherein the methyl-substituted hydrocarbon is toluene, and the partial oxidation product comprises benzaldehyde and benzoic acid.

10. An electrochemical process in accordance with claim 1 wherein the methyl-substituted hydrocarbon is p-xylene, and the partial oxidation product comprises p-toluic acid and terephthalic acid.

11. An electrochemical process in accordance with claim 1 wherein the anodic potential is controlled at a selected level by means of a self-adjustable unipolar resistive load.

12. An electrochemical process in accordance with claim 11 wherein the anodic potential is controlled at a constant level with a passive potentiostat device.

* * * * *